US012747920B2

(12) United States Patent
Underwood et al.

(10) Patent No.: US 12,747,920 B2
(45) Date of Patent: Sep. 29, 2026

(54) BEARING DELAYED FIREARM OPERATING SYSTEMS

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 19/060,368

(22) Filed: Feb. 21, 2025

(65) Prior Publication Data

US 2025/0271228 A1 Aug. 28, 2025

Related U.S. Application Data

(60) Provisional application No. 63/556,705, filed on Feb. 22, 2024.

(51) Int. Cl.
*F41A 3/62* (2006.01)

(52) U.S. Cl.
CPC ..... *F41A 3/62* (2013.01)

(58) Field of Classification Search
CPC ..... F41A 3/62
USPC ..... 89/180
See application file for complete search history.

(56) References Cited

U.S. PATENT DOCUMENTS

| | | | | |
|---|---|---|---|---|
| 1,365,355 | A | 1/1921 | Thompson | |
| 2,370,189 | A | 2/1945 | Penney | |
| 2,651,974 | A | 9/1953 | Simpson | |
| 2,717,535 | A | 9/1955 | Taylor | |
| 3,848,510 | A | 11/1974 | Wolpert | |
| 5,259,137 | A | 11/1993 | Blenk et al. | |
| 5,447,092 | A | 9/1995 | Dobbins | |
| 6,931,978 | B1 | 8/2005 | Dionne | |
| 7,571,671 | B2 | 8/2009 | Engel | |
| 7,721,639 | B2 | 5/2010 | Wössner | |
| 9,964,369 | B2 | 5/2018 | Garrow | |
| 10,151,544 | B1 | 12/2018 | Sugg | |
| 11,313,633 | B1 | 4/2022 | Richey | |
| 11,371,789 | B2 | 6/2022 | Underwood et al. | |
| 11,543,195 | B2 | 1/2023 | Underwood et al. | |
| 11,846,476 | B2 | 12/2023 | Underwood et al. | |
| 2005/0257682 | A1* | 11/2005 | Hajjar | F41A 3/46 89/188 |
| 2010/0180760 | A1 | 7/2010 | Polston | |
| 2010/0186581 | A1* | 7/2010 | Hajjar | F41A 3/46 89/188 |
| 2010/0269682 | A1* | 10/2010 | Vuksanovich | F41A 5/28 89/191.01 |
| 2014/0075807 | A1 | 3/2014 | Lewis | |
| 2016/0010938 | A1 | 1/2016 | Merkley et al. | |
| 2018/0142981 | A1 | 5/2018 | Collazo et al. | |
| 2020/0072567 | A1 | 3/2020 | Michut | |
| 2022/0003512 | A1* | 1/2022 | Underwood | F41A 3/62 |
| 2023/0099273 | A1* | 3/2023 | Craig | F41A 15/14 42/25 |
| 2025/0102250 | A1* | 3/2025 | Patel | F41A 3/26 |
| 2025/0198713 | A1* | 6/2025 | Jacobson | F41A 15/14 |

(Continued)

*Primary Examiner* — Samir Abdosh

(57) ABSTRACT

A firearm operating system includes a bolt with at least one bearing cavity, a carrier disposed on a rear side of the bolt, a plurality of bearings, and a barrel extension. The carrier includes a cavity. The plurality of bearings are retained in the barrel extension. The plurality of bearings are movable relative to the barrel extension.

21 Claims, 15 Drawing Sheets

(56) References Cited

U.S. PATENT DOCUMENTS

| | | | | |
|---|---|---|---|---|
| 2025/0237444 | A1* | 7/2025 | Steil | F41A 3/66 |
| 2025/0271228 | A1* | 8/2025 | Underwood | F41A 3/62 |

* cited by examiner

BEARING DELAYED FIREARM OPERATING SYSTEMS

CROSS REFERENCE TO RELATED APPLICATIONS

This application is related to and claims priority benefit from U.S. Provisional Application No. 63/556,705 ("the '705 application"), filed on Feb. 22, 2024. This application is also related to U.S. application Ser. No. 16/987,204 ("the '204 application"), filed on Aug. 6, 2020, U.S. application Ser. No. 17/367,288 ("the '288 application"), filed on Jul. 2, 2021, and U.S. application Ser. No. 17/960,587 ("the '587 application"), filed on Oct. 5, 2022. The '705 application, the '204 application, the '288 application, and the '587 application are each hereby incorporated in their entirety by this reference.

FIELD OF THE INVENTION

The field of the invention relates to firearms, particularly firearms with operating systems that include a bearing delay mechanism.

BACKGROUND

Many modern firearms (including handguns, rifles, carbines, shotguns, etc.) rely on operating systems using blowback or gas pressure (including direct gas impingement arrangements, gas piston arrangements, or other appropriate arrangements). However, for compatibility with various calibers (including rifle calibers, pistol calibers, or other appropriate calibers), blowback or gas pressure operating systems are difficult to adapt to a wide variety of calibers. Adjustments for these operating systems may be necessary due to mass of the cartridge for various calibers to ensure suitable function of the firearm, including a sufficient delay between firing the projectile and rearward movement of the firearm bolt.

To simplify the firearm operating system, to increase reliability, and to increase safety, it may be desirable to design a new operating system that includes a bearing delayed operating system. Such a design can allow for modular firearm components to be combined with the new bearing delayed operating system.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a firearm operating system comprises: a bolt comprising at least one bearing cavity; a carrier disposed on a rear side of the bolt, wherein the carrier comprises a cavity; a plurality of bearings; and a barrel extension, wherein: the plurality of bearings are retained in the barrel extension; and the plurality of bearings are movable relative to the barrel extension.

DETAILED DESCRIPTION

Figure 1:
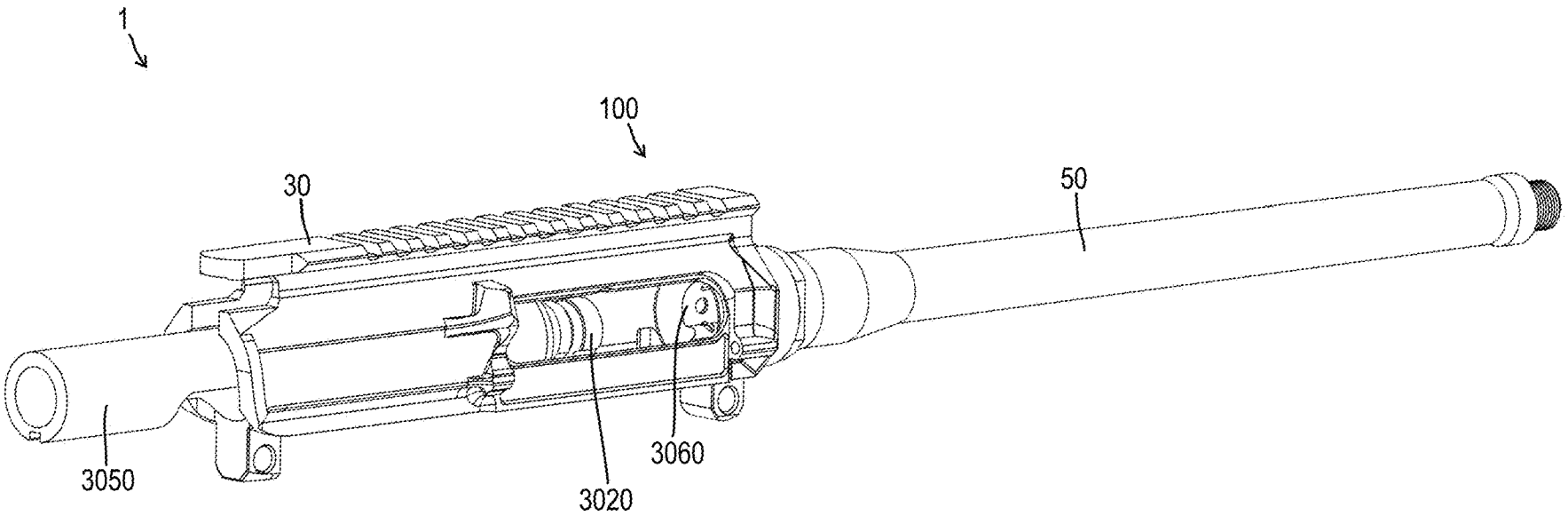
FIG. 1 is a perspective view of a firearm operating system for a firearm according to certain embodiments of the present invention.
Figure 2:
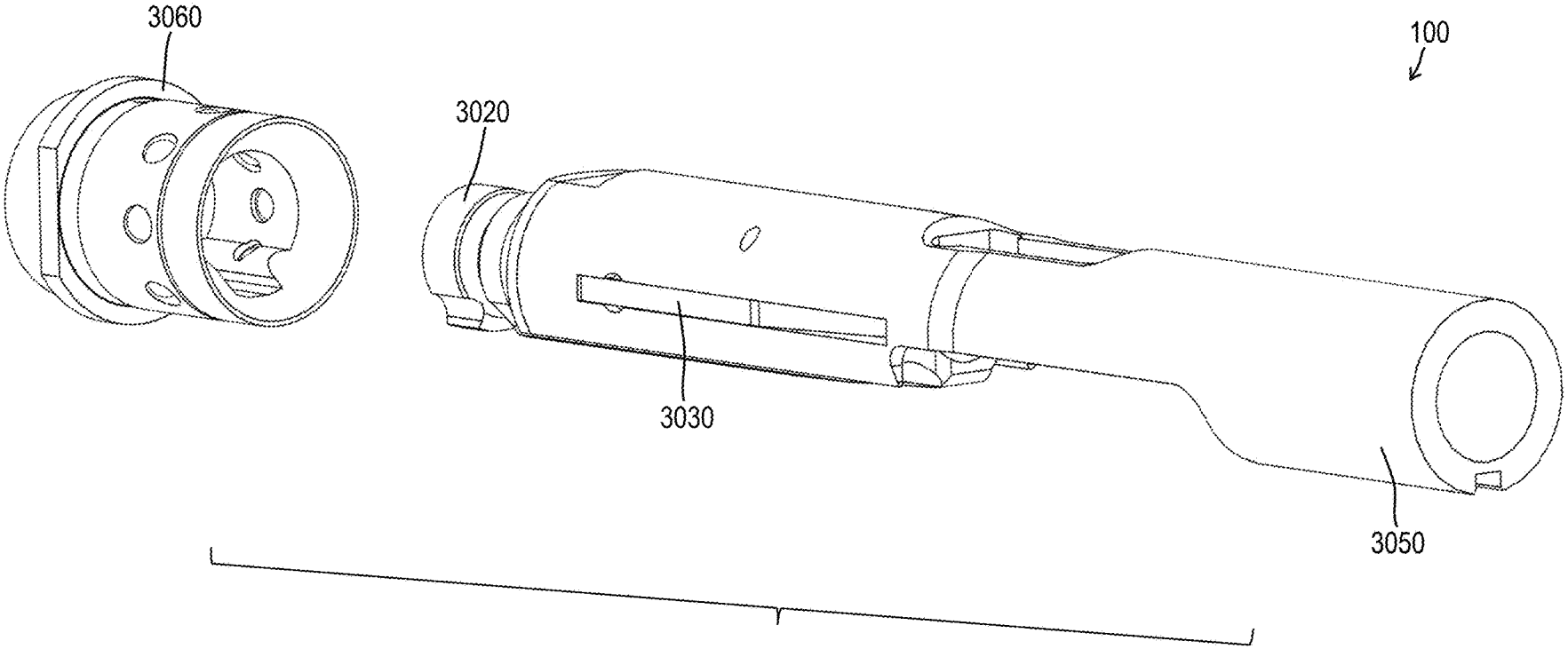
FIG. 2 is a left side perspective view of the firearm operating system of FIG. 1.
Figure 3:
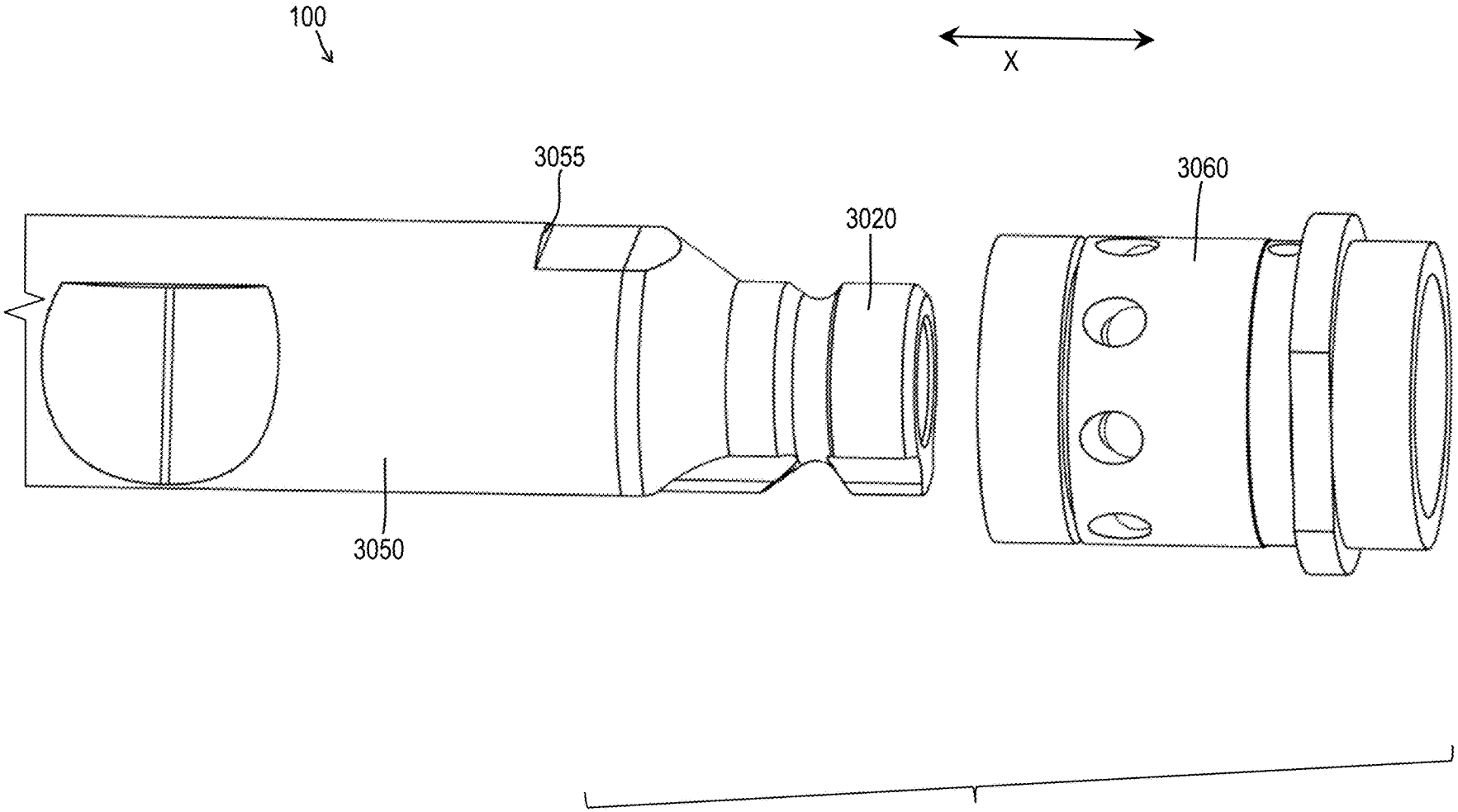
FIG. 3 is a right side partial perspective view of the firearm operating system of FIG. 1.
Figure 4A:
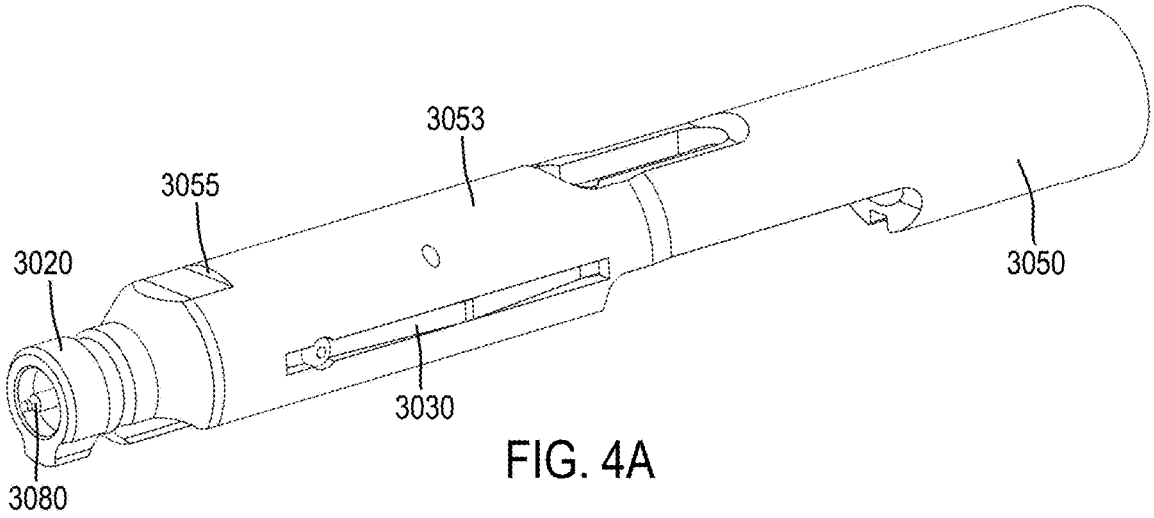
FIG. 4A is a front left partial perspective view of the firearm operating system of FIG. 1.
Figure 4B:
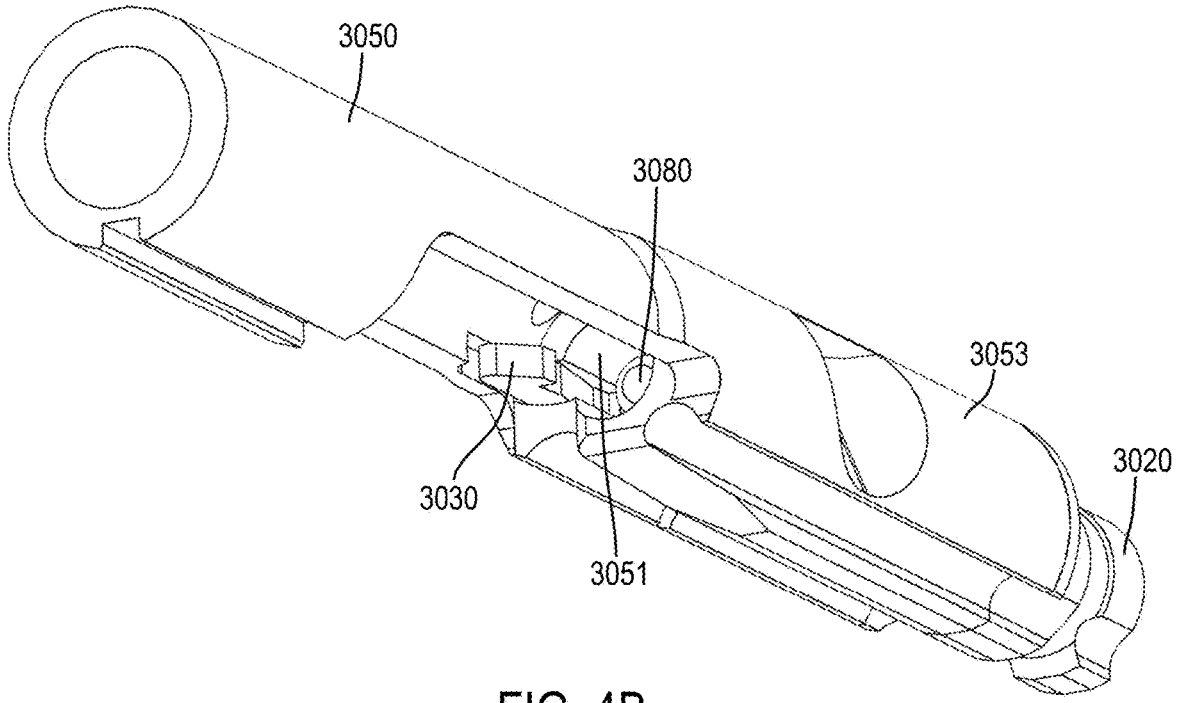
FIG. 4B is a rear right partial perspective view of the firearm operating system of FIG. 1.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1-14 illustrate components of various semi-automatic or automatic firearms, the features, concepts, and functions described herein are also applicable (with potential necessary alterations for particular applications) to handguns, rifles, carbines, pistols, shotguns, or any other type of firearm. Furthermore, the embodiments may be compatible with various calibers including rifle calibers such as, for example, 5.56×45 mm NATO, .223 Remington, 7.62×51 mm NATO, .308 Winchester, 7.62×39 mm, 5.45×39 mm; pistol calibers such as, for example, 9×19 mm, .45 ACP, .40 S&W, .380 ACP, 10 mm Auto, 5.7×28 mm; and shotgun calibers such as, for example, 12 gauge, 20 gauge, 28 gauge, .410 gauge, 10 gauge, 16 gauge.

In some embodiments, the firearm operating systems 2000, 3000, 5000, 6000, 7000 are configured to be inserted into a U.S. military specification (milspec) upper receiver for an AR-15 variant (civilian) or M16/M4 (military) firearm (i.e., collectively AR-15 style firearms).

According to certain embodiments of the present invention, as shown in FIGS. 1-14, a firearm operating system 3000 may include a bolt 3020, a carrier 3050, and a barrel extension 3060. The firearm operating system 3000 may be incorporated into a firearm that includes an upper receiver 30 and a barrel 50 (for example, see firearm 1 shown in FIG. 1). Other components (e.g., lower receiver, magazine, charging handle, handguard, ejector, extractor, etc.) are not illustrated for simplicity. In some cases, the firearm operating system 3000 is located within the upper receiver 30. The firearm operating system 3000 may be designed as an assembly of components to fit within a standard upper receiver for a known modular firearm such that the upper receiver 30 (including the firearm operating system 3000) can interface with a standard lower receiver. For example, the firearm operating system 3000 may be designed to function and engage with (i) components of AR-15 variant (civilian) or M16/M4 (military) firearms; (ii) components of AR-10 variant firearms; or (iii) components of any other relevant firearm.

In some cases, the overall shape of the bolt 3020 includes a forward portion 3104, a profile surface 3105, an outer portion 3106, a lower portion 3108, and a rear portion 3109. The bolt 3020 may include a forward face 3103, a rear face 3107, a lower portion 3108, a rear cavity 3029, at least one bearing cavity 3024, and a forward cavity 3028, (see FIGS. 6A-6C). In some embodiments, the at least one bearing cavity 3024 includes single recess or groove (see FIGS. 6A and 6B). In other embodiments, the at least one bearing cavity 3024 includes a plurality of individual cavities. For example, the at least one bearing cavity 3024 may include a first bearing cavity 3024.1, a second bearing cavity 3024.2, a third bearing cavity 3024.3, a fourth bearing cavity 3024.4, etc. (see FIG. 6C). The number of individual bearing cavities 3024 may correspond to the number of bearings 3023. The bearing cavity 3024 (or bearing cavities 3024) may each include an operating surface 3024*a* that interfaces with the bearings 3023 when the bolt goes into battery (i.e., engages the barrel extension 3060). Each operating surface 3024*a* has a geometric relationship with the direction X. In some embodiments, each operating surface 3024*a* is oblique to the direction X. Each operating surface 3024*a* may have a linear profile or cross section or may be non-linear (e.g., may include curves or compound curves) for the interaction between the operating surface 3024*a* and the bearing 3023. As shown in FIGS. 9A-11B, the bolt 3020 may interface with at least one bearing 3023. In some embodiments, the at least one bearing 3023 includes a plurality of bearings. Although the bearings 3023 are illustrated as spherical (ball) bearings, the bearings 3023 may have any configuration, including, for example, cylindrical, tapered, needle, toroidal, annular, etc.

Figure 8A:
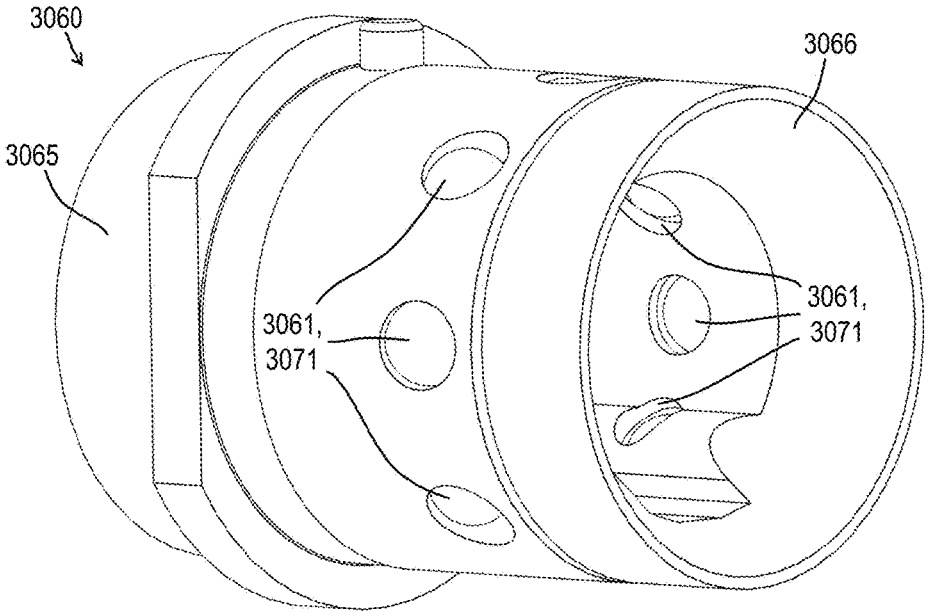
FIG. 8A is a rear left perspective view of a barrel extension of the firearm operating system of FIG. 1.
Figure 8B:
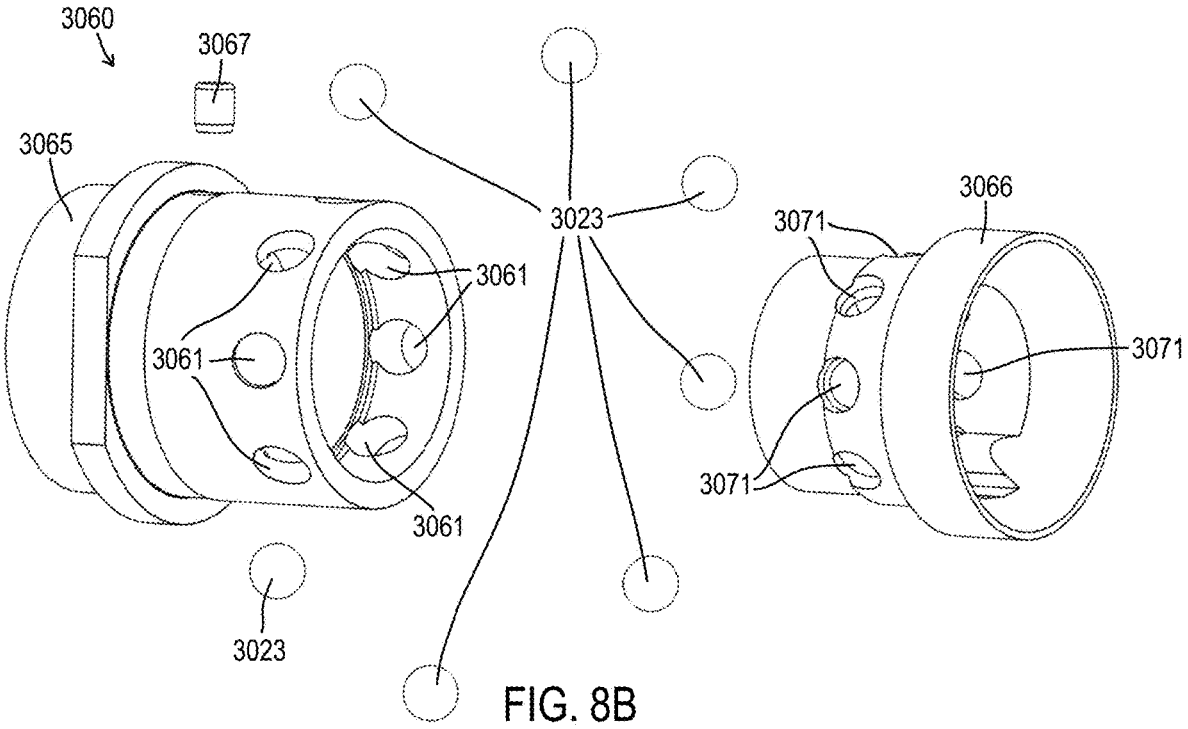
FIG. 8B is an exploded perspective view of the barrel extension of FIG. 8A.
Figure 9A:
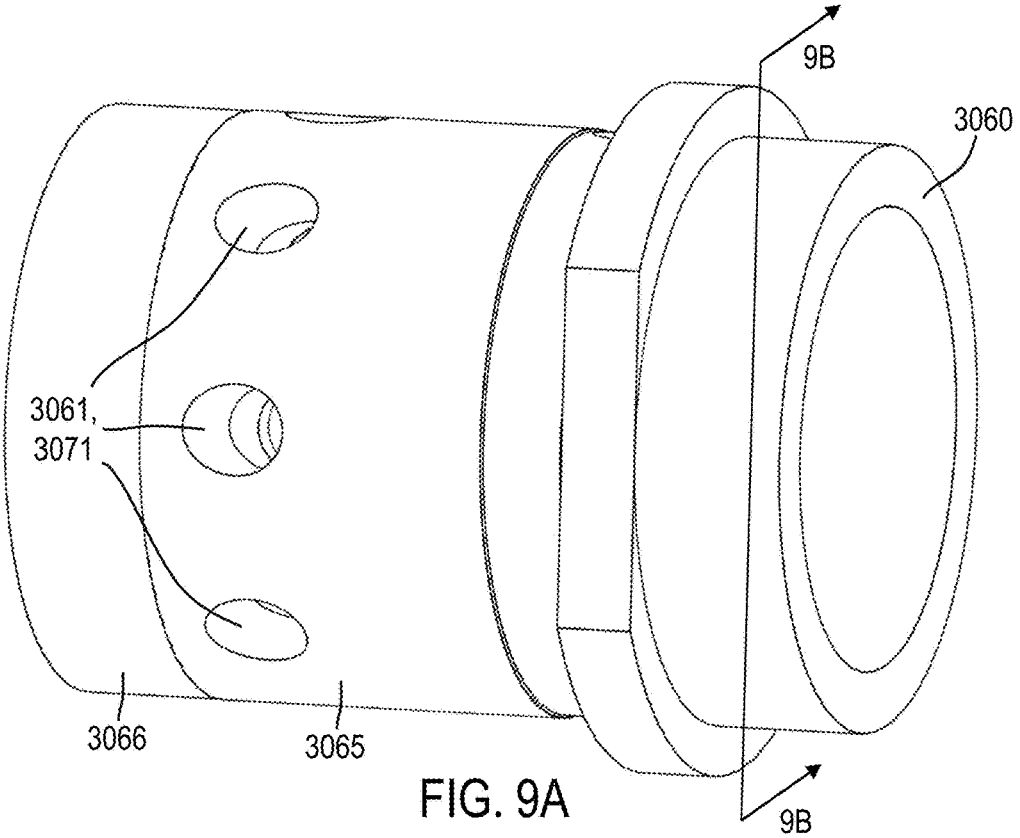
FIG. 9A is a perspective view of a barrel extension and a portion of a bolt of the firearm operating system of FIG. 1.
Figure 9B:
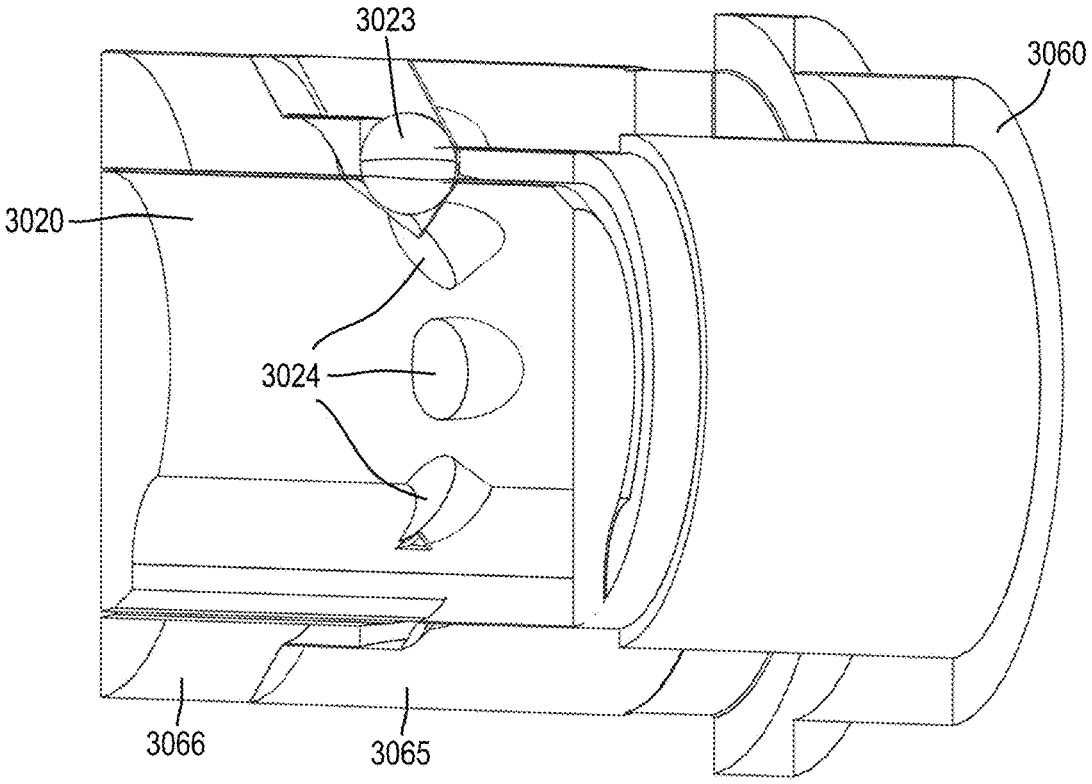
FIG. 9B is a cross-sectional view of the barrel extension and the bolt of FIG. 9A.
Figure 10A:
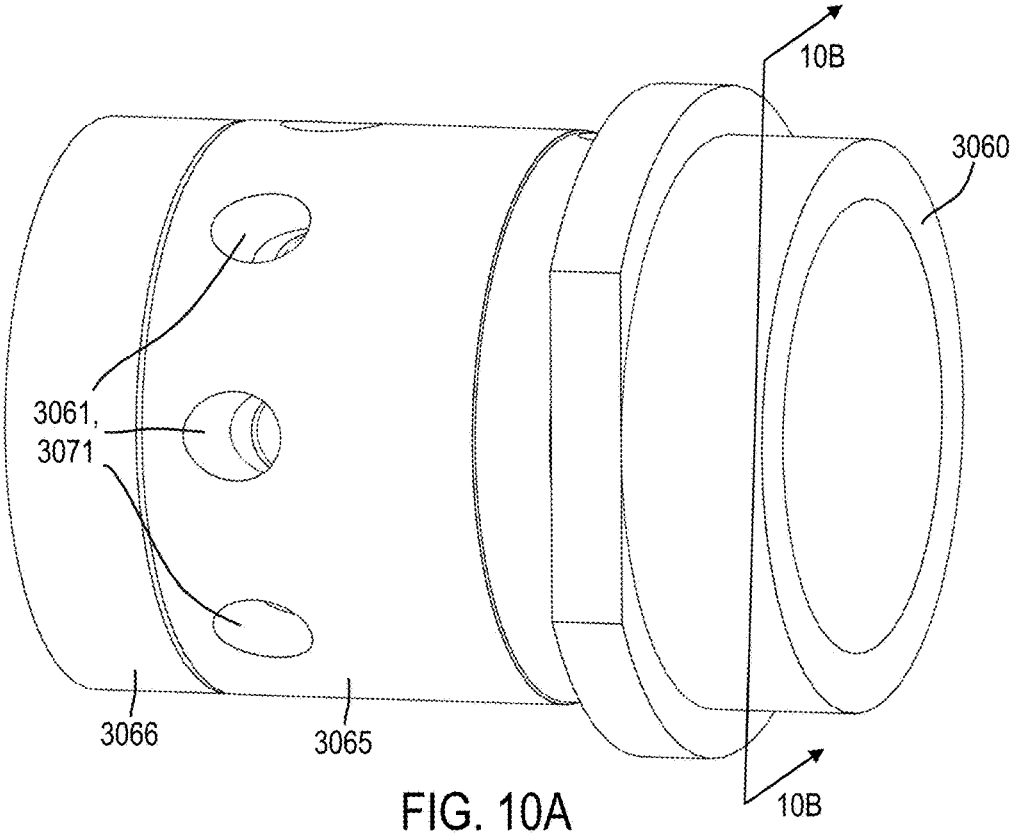
FIG. 10A is a perspective view of a barrel extension and a portion of a bolt of the firearm operating system of FIG. 1.
Figure 10B:
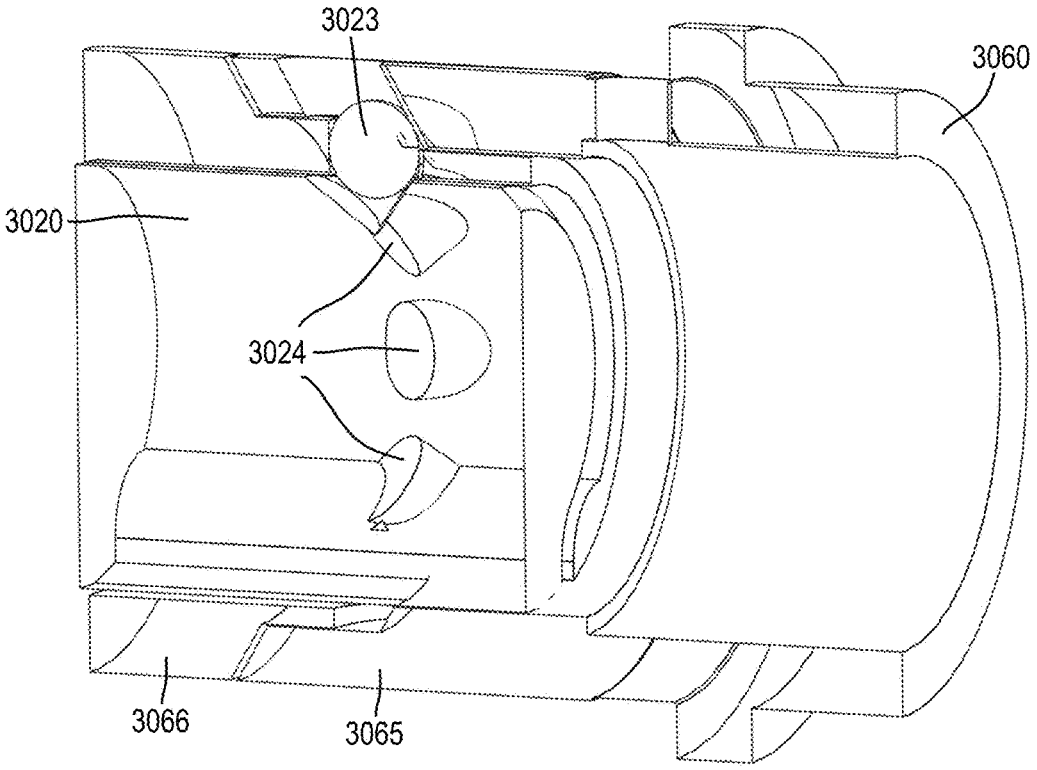
FIG. 10B is a cross-sectional view of the barrel extension and the bolt of FIG. 10A.
Figure 11A:
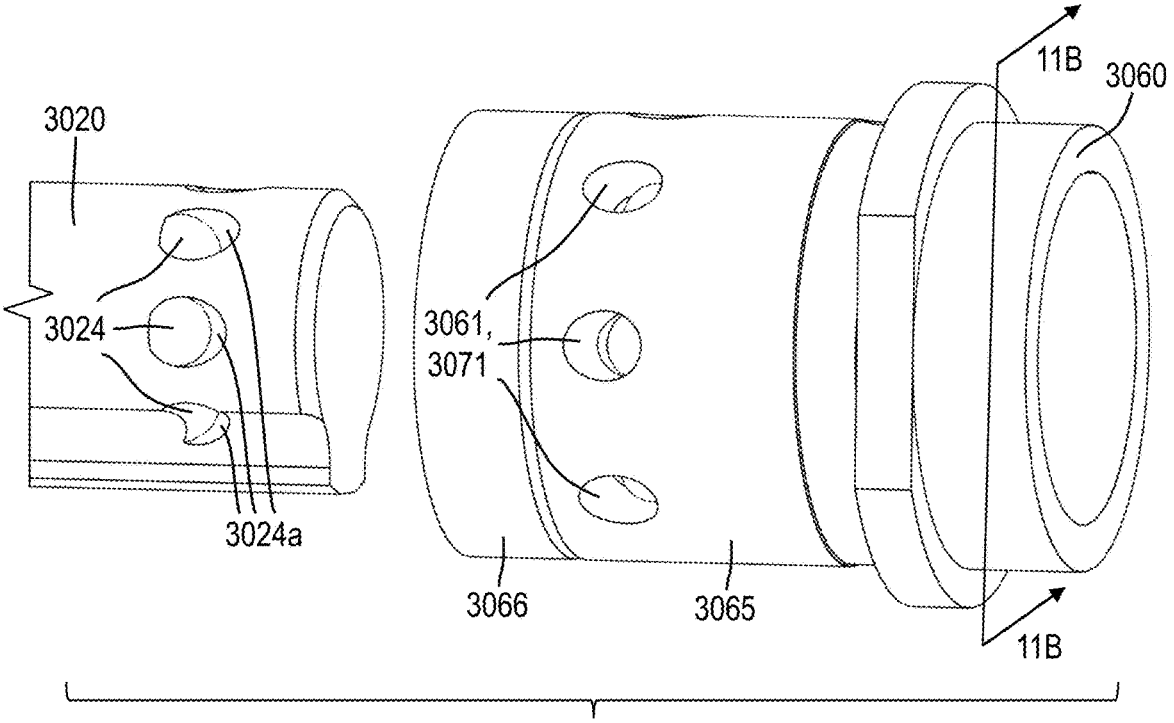
FIG. 11A is a perspective view of a barrel extension and a portion of a bolt of the firearm operating system of FIG. 1.
Figure 11B:
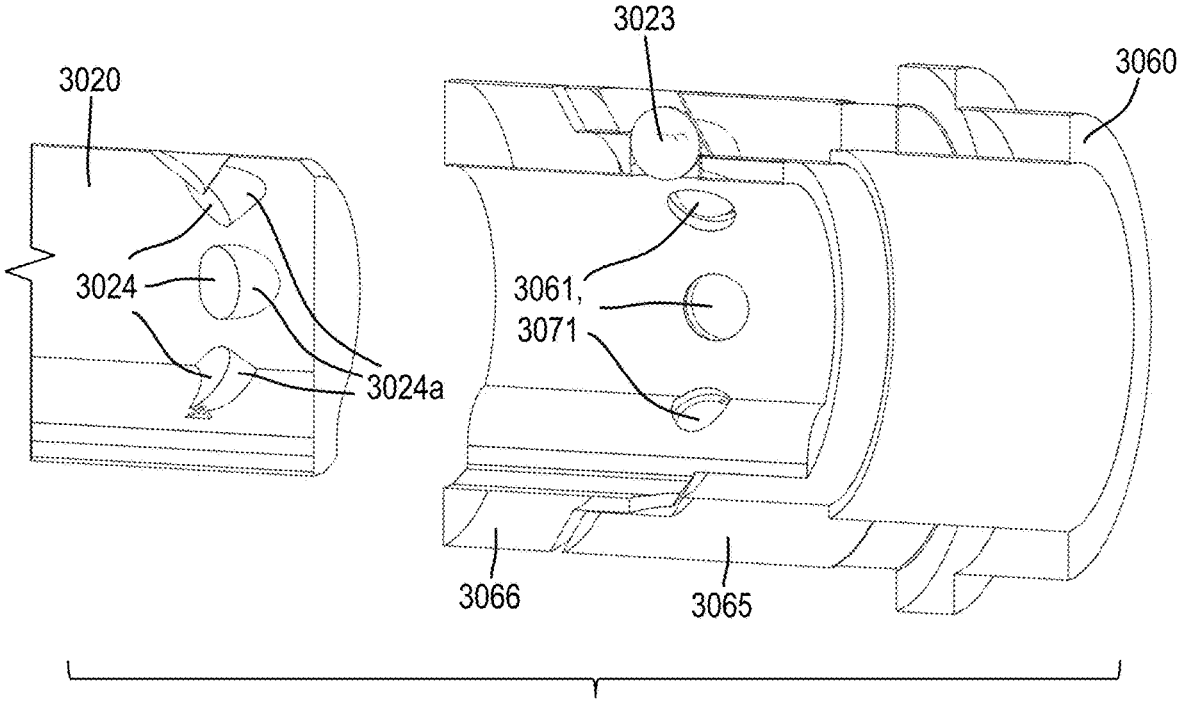
FIG. 11B is a cross-sectional view of the barrel extension and the bolt of FIG. 11A.

As shown in FIGS. 8A and 8B, the barrel extension 3060 may include an outer member 3065, an inner member 3066, an alignment pin 3067, and a plurality of bearings 3023. The alignment pin 3067 may be located at the top of the barrel extension 3060 and is used to ensure the barrel extension 3060 remains aligned with the upper receiver 30. In some cases, the outer member 3065 includes a plurality of recesses 3061 that correspond to the plurality of bearings 3023. Each recess 3061 may pass partially or entirely through the outer member 3065. In some embodiments, each recess 3061 passes entirely through the outer member 3065 such that the appropriate bearing 3023 can move through the outer member 3065. The inner member 3066 may include a set of recesses 3071 designed to correspond to the recesses 3061 of the outer member 3065. In some embodiments, the bearings 3023 are retained in the barrel extension 3060 because the barrel extension 3060 is inserted into the upper receiver 30 such that the bearings 3023 cannot exit through the external surface of the outer member 3065. In some embodiments, each recess 3071 may include a retaining portion 3072 that prevents the bearing 3023 from passing entirely through the recess 3071 (i.e., where the bearing 3023 can partially protrude but cannot move entirely through the recess 3071). As one example, each retaining portion 3072 may include a machined profile near the outer edge where the dimension (e.g., diameter) of the recess 3071 decreases when nearing the outer portion of the recess 3071. The retaining portion 3072 may be an integral feature (e.g., a machined feature as described above, a welded feature, etc.) or may be an additional component added to the inner member 3066.

Figure 12A:
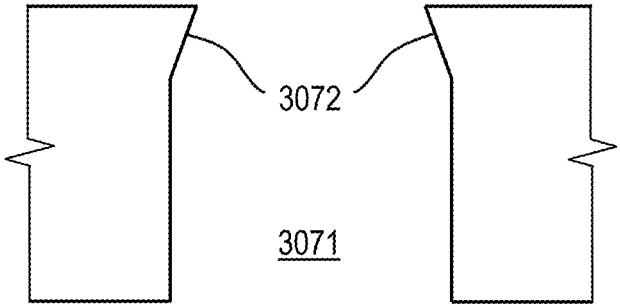
FIG. 12A is a schematic section view of a bearing recess of the firearm operating system of FIG. 1.
Figure 12B:
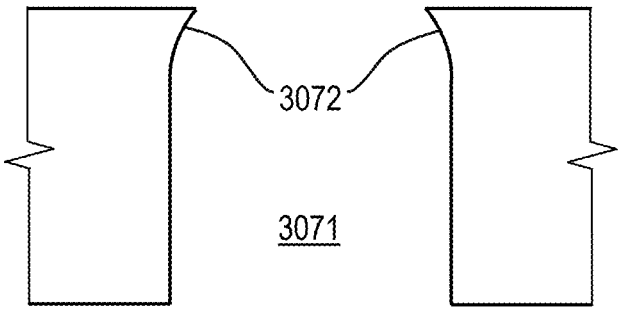
FIG. 12B is a schematic section view of a bearing recess of the firearm operating system of FIG. 1.

FIGS. 12A and 12B each show schematic cross-section examples of a recess 3071 of the inner member 3066 that includes a retaining portion 3072. As shown in FIG. 12A, in some embodiments, the retaining portion 3072 is a tapered surface that reduces the size of the recess 3071 linearly. For examples where the recess 3071 has a circular cross-section, retaining portion 3072 is a tapered surface that reduces the diameter of the recess 3071 and results in a conical profile. If the bearing 3023 is a spherical bearing (i.e., the illustrated embodiment for bearings 3023), the engagement between the retaining portion 3072 and the bearing 3023 may be formed as a curve (e.g., a circle). FIG. 12B shows embodiments where the retaining portion 3072 is a tapered surface that reduces the size of the recess 3071 non-linearly. For examples where the recess 3071 has a circular cross-section, retaining portion 3072 is a curved surface that reduces the diameter of the recess 3071. In some examples, the interior of the retaining portion 3072 results in a spherical profile. If the bearing 3023 is a spherical bearing (i.e., the illustrated embodiment for bearings 3023), the engagement between the retaining portion 3072 and the bearing 3023 may be formed as a surface and/or a series of curves/circles.

Based on the configuration of the recesses 3071 and the retaining portions 3072, the bearings 3023 cannot exit through the recesses 3071 toward the interior of the barrel extension 3060. In some embodiments, the only option for removing the bearings 3023 is to disassemble the barrel extension 3060 from the upper receiver 30. The bearings 3023 could then be removed through outer member 3065.

The barrel extension 3060 may be designed such that recesses 3061 or recesses 3071 (or both recesses 3061 and recesses 3071) are tapered. In other words, at least some of the recesses 3061, 3071 are created with an angle that is oblique relative to the direction X. In some embodiments, the outer member 3065 is configured such that the recesses 3061 each extend in a direction that is perpendicular to the direction X and the inner member 3066 is configured such that the recesses 3071 each extend in a direction that is oblique to the direction X. In other embodiments, the outer member 3065 is configured such that the recesses 3061 each extend in a direction that is oblique to the direction X and the inner member 3066 is configured such that the recesses 3071 each extend in a direction that is oblique to the direction X.

In some embodiments, the bearings 3023 are evenly distributed around the surface of the bolt 3020 (i.e., approximately equal angles apart from one another). In other cases, the bearings 3023 are not equally distributed in order to avoid features of the bolt 3020 (e.g., the ejector, the extractor, etc.). As one example, a first bearing 3023 may be located at the 4 o'clock position when viewing the forward face 3103 of the bolt 3020 while a second bearing 3023 may be located at the 8 o'clock position and a third bearing 3023 may be located at the 12 o'clock position. Such an arrangement avoids the lower portion 3108 and an extractor cavity of the bolt 3020.

The firearm operating system 3000 may include any number of bearings 3023. In some embodiments, the firearm operating system 3000 includes as few as two bearings 3023. The total number of bearings 3023 may be even or odd. In some embodiments, there are three bearings 3023. Other embodiments may include four, five, six, seven, eight, nine, ten, eleven, twelve, thirteen, fourteen, fifteen, or any other appropriate number of bearings 3023.

Figure 5:
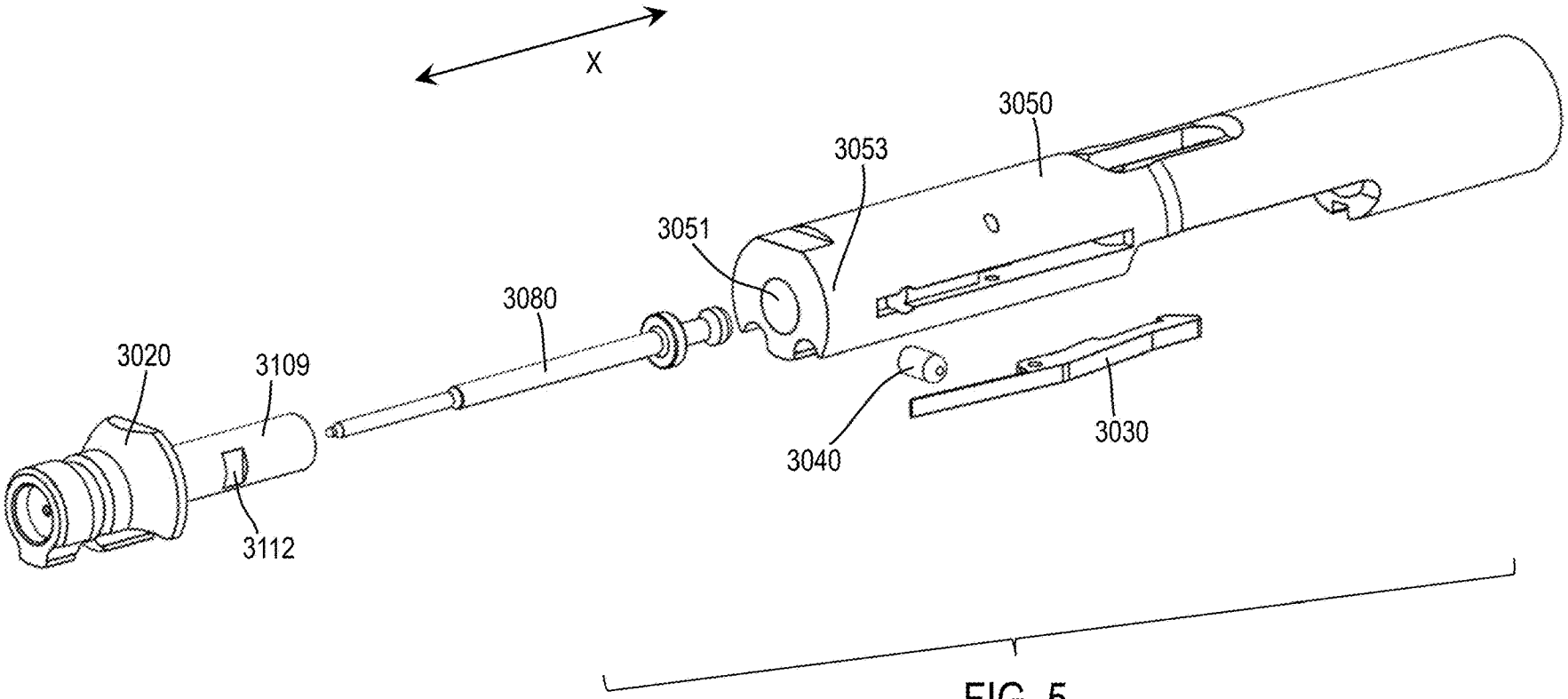
FIG. 5 is a partial front exploded perspective view of the firearm operating system of FIG. 1.
Figure 6A:
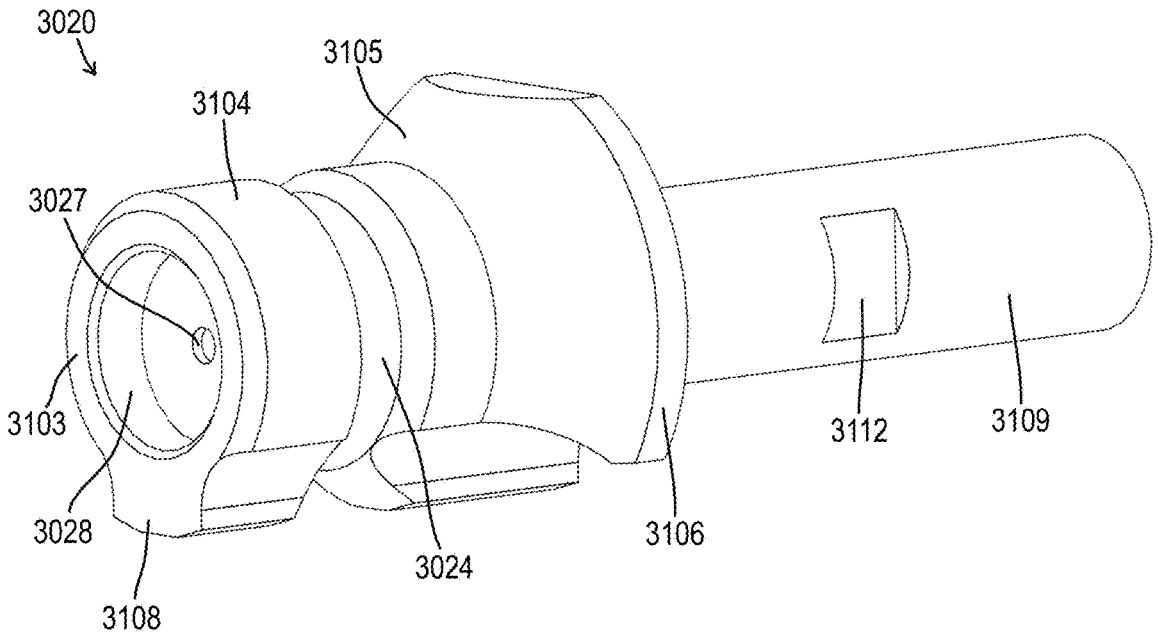
FIG. 6A is a front left perspective view of a bolt of the firearm operating system of FIG. 1.
Figure 6B:
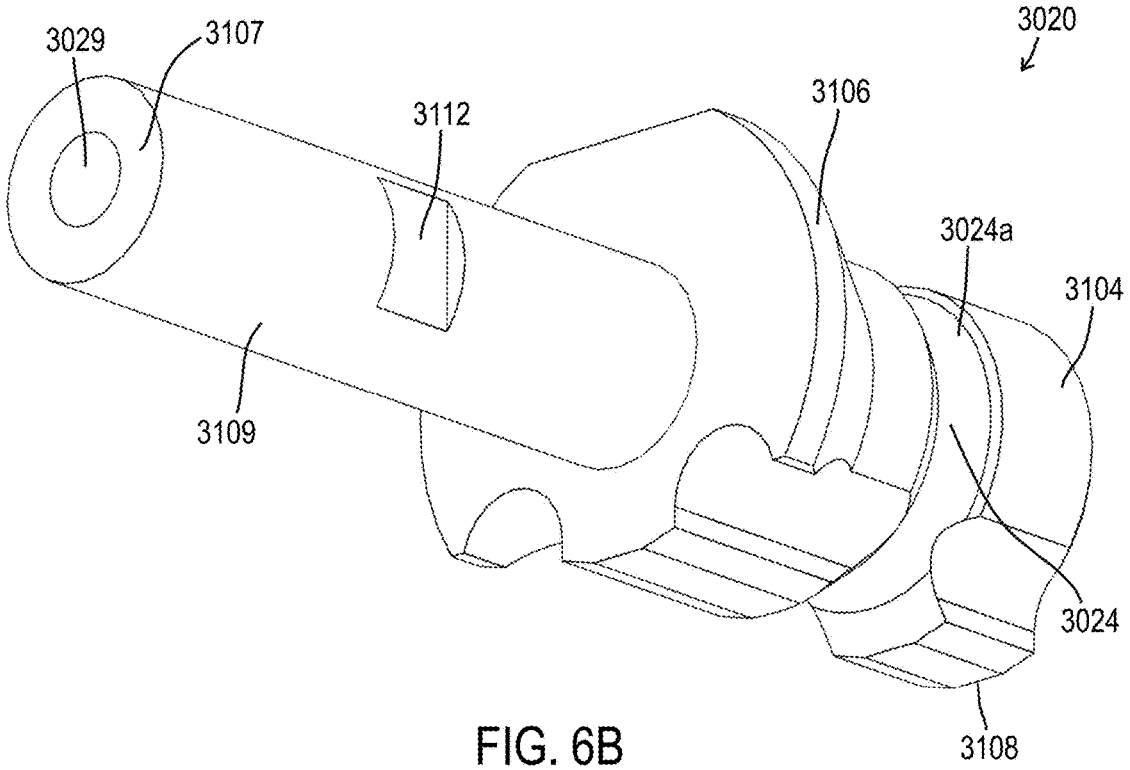
FIG. 6B is a rear right perspective view of the bolt of FIG. 6A.
Figure 6C:
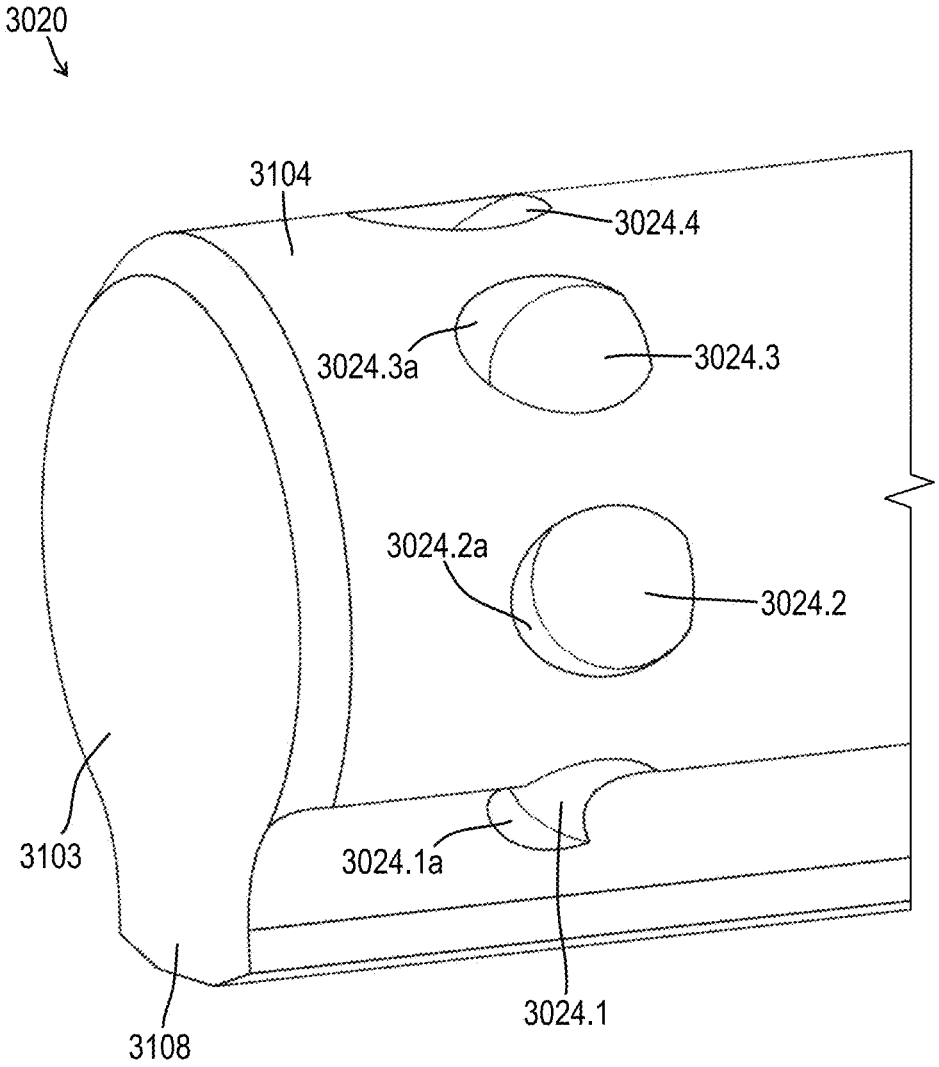
FIG. 6C is a partial front left perspective view of a bolt of the firearm operating system of FIG. 1.
Figure 7A:
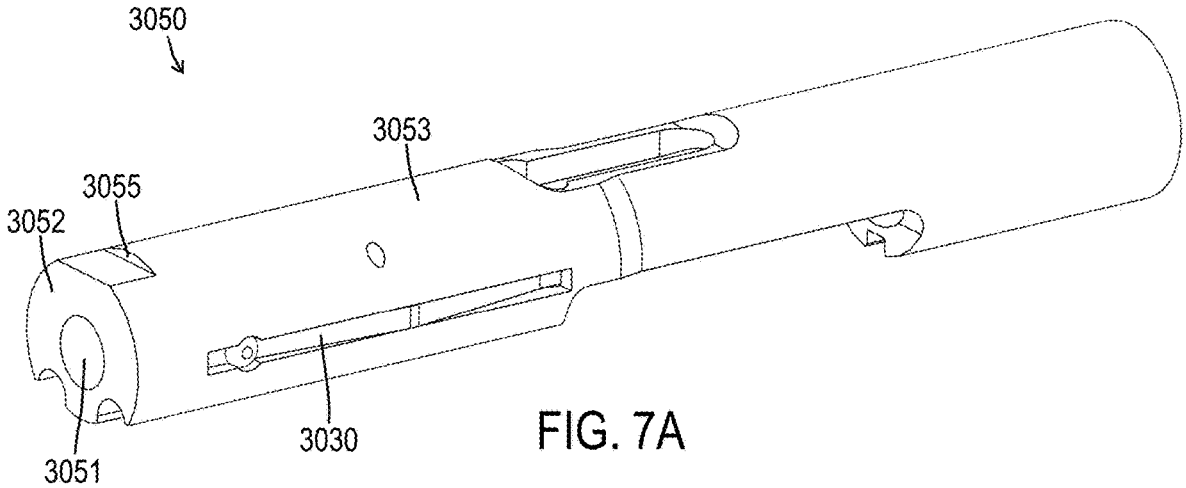
FIG. 7A is a front left perspective view of a carrier of the firearm operating system of FIG. 1.
Figure 7B:
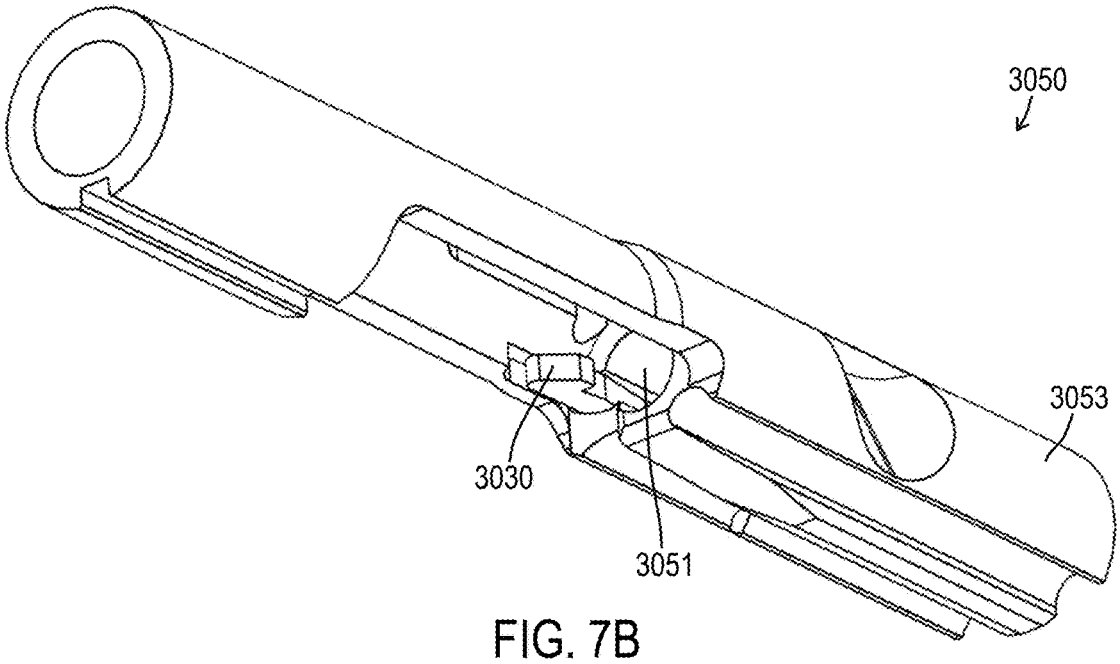
FIG. 7B is a rear right perspective view of the carrier of FIG. 7A.

In some embodiments, the bolt 3020, the carrier 3050, and the firing pin 3080 combine together as one unit within the firearm operating system 3000. As shown in FIGS. 1-4B, the bolt 3020 may be disposed on a forward side of the carrier 3050. The firing pin 3080 may extend internally into and/or through a rear cavity 3029 of the bolt 3020 (see FIGS. 4A and 4B) and into/through the cavity 3051 of the carrier 3050 (see FIG. 4B). In some cases, the firing pin 3080 extends through central hole 3027 of the bolt 3020 such that the firing pin 3080 may protrude into forward cavity 3028 of the bolt 3020 where the firing pin may interface with a cartridge. The firearm operating system 3000 may also include a lever arm 3030 that constrains movement of the bolt 3020 relative to the carrier 3050 (see FIGS. 2, 4A, and 5). In addition, the firearm operating system 3000 may include a lever protrusion 3040 that is designed to engage a corresponding feature of the bolt 3020 (e.g., notch 3112). The lever protrusion 3040 may be an integral component at the forward end 3032 of the lever arm 3030. In other embodiments, as shown in FIG. 5, the lever protrusion 3040 may be a separate component from the lever arm 3030. In some embodiments, the lever protrusion 3040 is a cylindrical rod (see FIG. 5) while in other cases, the bearing spacer 3040 has an arched shape, crescent shape, a polygonal cross section (e.g., rectangular, square, pentagonal, hexagonal, etc.), and/or any other appropriate shape.

Figure 13A:
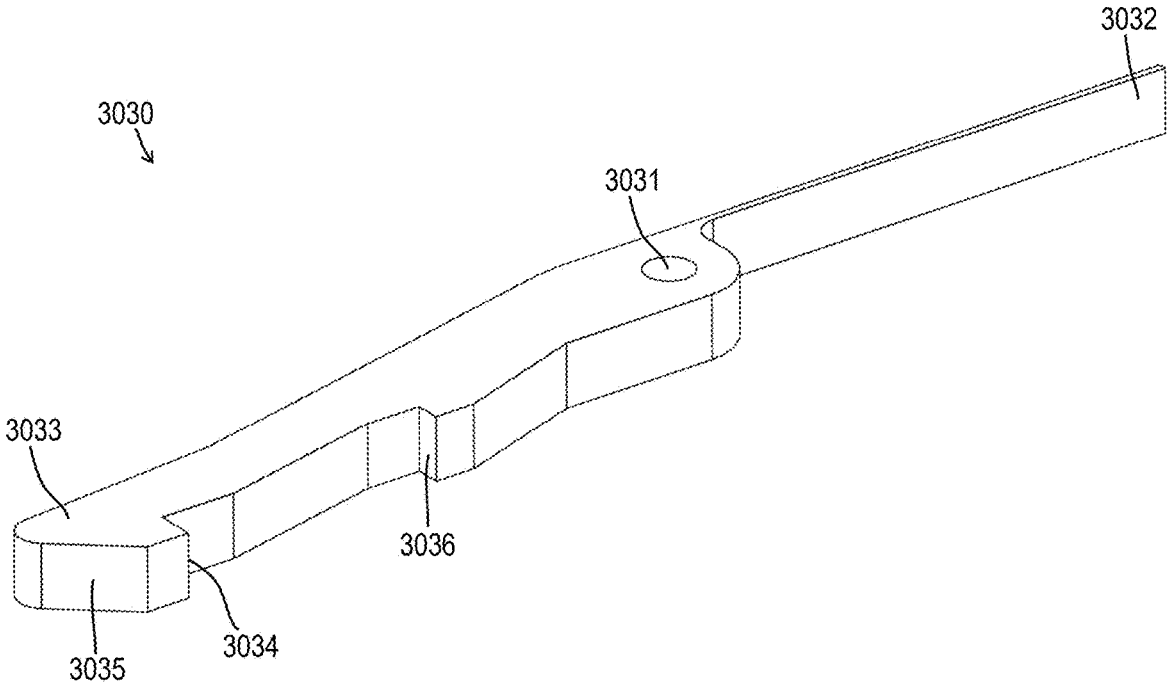
FIG. 13A is a perspective view of a lever arm of the firearm operating system of FIG. 1.
Figure 13B:
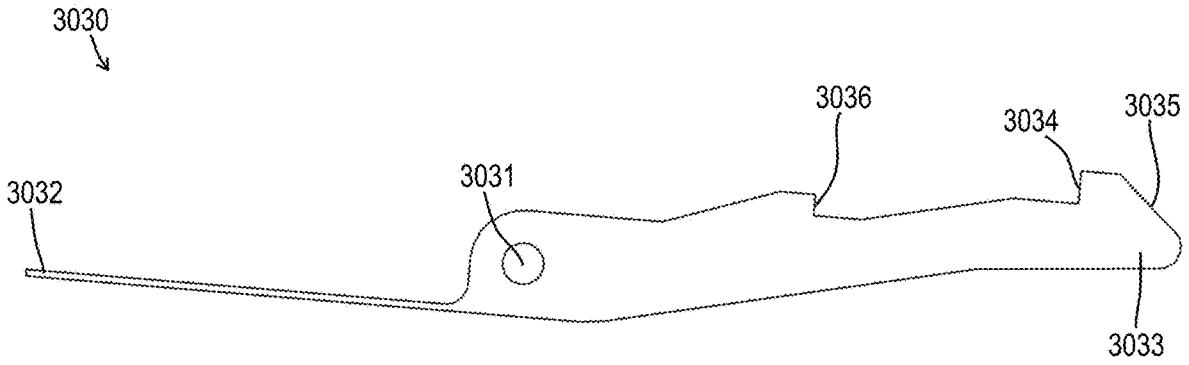
FIG. 13B is a top view of the lever arm of FIG. 13A.
Figure 14:
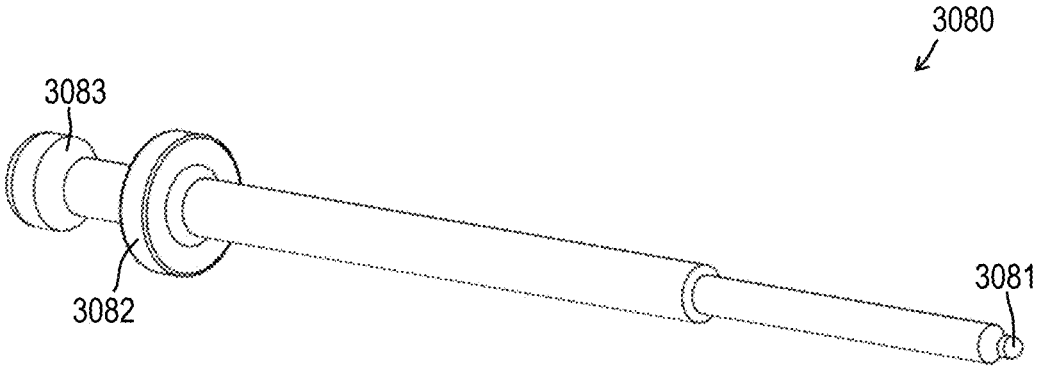
FIG. 14 is a perspective view of a firing pin of the firearm operating system of FIG. 1.

As shown in FIGS. 13A and 13B, the lever arm 3030 may include a pivot 3031 that is approximately centrally located, a forward end 3032, and a rear end 3033. As described above, the lever arm 3030 may interface with the lever protrusion 3040 at the forward end 3032. In some embodiments, the rear end 3033 includes a first notch 3034 and a interface surface 3035. The lever arm 3030 may also include a second notch 3036. The first notch 3034 may function to prevent the firing pin 3080 from exiting rearward from the bolt assembly. In particular, the first notch 3034 can be configured to engage the flange 3082 of the firing pin 3080. In some embodiments, the lever arm 3030 acts as a safety device that prevents unintended or negligent discharges of the firearm 1. For example, the second notch 3036 may be configured to engage flange 3082 to prevent the firing pin 3080 from moving forward to discharge a cartridge. To overcome this safety feature, the hammer of the fire control group (not shown) moves to press the rear end 3083 of the firing pin 3080 but must first push the interface surface 3035 causing the lever arm 3030 to rotate about pivot 3031, which moves second notch 3036 away from flange 3082. In other words, the firing pin 3080 cannot discharge a cartridge unless the firearm's hammer engages the firing pin 3080.

The carrier 3050 may include a cavity 3051, a forward face 3052, and an outer surface 3053. The bolt 3020 and the carrier 3050 may be movable relative to one another in the X-direction such that the firearm operating system 3000 has an assembled configuration and a disassembled configuration. In some embodiments, in the assembled configuration, the carrier 3050 and the bolt 3020 are attached to one another such that the outer portion 3106 is approximately continuous with the outer surface 3053 of the carrier 3050. In the assembled configuration, the lever protrusion 3040 engages the notch 3112 to prevent forward movement of the bolt 3020. To disassemble the bolt 3020 from the carrier 3050, the bolt 3020 is rotated about its central axis (that is concentric with the central hole 3027 and the rear cavity 3029) to disengage the lever protrusion 3040 from the notch 3112. After disengagement, the bolt 3020 can slide forward relative to the carrier 3050 such that the rear portion 3109 exits the cavity 3051 of the carrier 3050 and the components are in the disassembled configuration.

In some embodiments, at least a portion of the rear portion 3109 of the bolt 3020 is disposed within an internal cavity of the carrier 3050 (e.g., cavity 3051) and at least a portion of the firing pin 3080 is disposed within the cavity 3051 of the carrier 3050 wherein the bolt 3020 is located on a forward side of the carrier 3050. Cycling of the firearm operating system 3000 is based on linear motion of various components in the forward/aft direction X including, for example, the bolt 3020, the carrier 3050, and the firing pin 3080.

For the firing pin 3080 to function (i.e., for the forward end 3081 of the firing pin 3080 to contact and cause the cartridge to discharge), the firearm operating system 3000 must be in the deployed configuration. In other words, the bolt 3020 must be in a forward position, which affects the position of the bearings 3023*a*, 3023*b*, and 3023*c* thus causing these bearings to interface with both recesses 3061, 3071 and the at last one cavity 3024 of the bolt 3020. Accordingly, a cartridge can only be fired when the firearm operating system 3000 is in the deployed configuration. As described in more detail below, the deployed configuration includes a condition where the bearings 3023 are engaged with the at last one cavity 3024.

In addition, the firearm operating system 3000 allows the firearm 1 to include a barrel 50 without a hole for venting/redirecting gas pressure to the operating system. In other words, another advantage compared to conventional systems is that the barrel 50 of the firearm operating system 3000 is simpler and less likely to corrode or otherwise fail due to additional holes thus increasing longevity.

When the bolt 3020 moves forward over the top of a magazine, the lower portion 3108 pushes the upper-most cartridge out of the magazine and toward the chamber of the firearm 1. In some embodiments, as shown in FIG. 23D, the bolt 3020 may include a gap 3108.1 in the lower portion 3108, which allows excess gas and carbon to escape from the forward cavity 3028. When the cartridge is in the chamber in a firing position, the cartridge is approximately aligned with a center of the forward face 3103 of the bolt 3020 such that the central hole 3027 of the bolt 3020 is aligned with the primer of the cartridge (to align the firing pin 3080 with the cartridge). When the cartridge is in the firing position, forward motion of a forward end 3081 of the firing pin 3080 (e.g., caused by a hammer interacting with the rear end 3083 of the firing pin 3080) causes the cartridge to discharge.

Manual operation/cycling of the firearm operating system 3000 may include rearward movement of the charging handle where the charging handle engages a portion of the firearm operating system 3000. For example, in some embodiments, the charging handle engages the forward face 3052 or notch 3055 of the carrier 3050. In other embodiments, the charging handle engages a gas key.

As described above, the firearm operating system 3000 may include at least one bearing 3023. In some embodiments, each bearing 3023 has a diameter of approximately 0.1" (0.25 cm) to approximately 0.4" (1.02 cm). In other cases, each bearing 3023 has a diameter of approximately 0.2" (0.51 cm) to approximately 0.3" (0.76 cm). In other cases, each bearing has a diameter of approximately 0.25" (0.635 cm).

When the firearm operating system 3000 is in the forwardmost configuration relative to the firearm 1, the bearings 3023 interface with both the bolt 3020 and the barrel extension 3060. There is forward pressure on the rear portion of the carrier 3050 (e.g., due to forward momentum of the components of firearm operating system 3000 and/or pressure from a buffer spring, which is not shown), which consequently pushes the bolt 3020 in the forward direction. Accordingly, when the firearm operating system 3000 is in the deployed configuration and located in a forward position, the bearing(s) 3023 engage the barrel extension 3060 and the bolt 3020 to lock the firearm operating system 3000 in a condition ready to fire (i.e., in battery).

After a cartridge is fired, the mechanisms described above cause a delay before the bolt assembly (the bolt 3020, the carrier 3050 and other related components) can move rearward away from the chamber. In particular, the bearings 3023 press against the curved/tapered surface on the rear side of the recesses 3061, 3071 of the barrel extension 3060 and against the operating surface(s) 3024*a* of the bolt 3020. The interaction between these recesses 3061, 3071 of the barrel extension 3060 and the bearings 3023 presses the bearings 3023 outward (away from the interior of the bolt 3020) while other portions of the bearings 3023 press against the operating surface(s) 3024*a* of the bolt 3020. In some cases, the surface geometry of (i) the recesses 3061, 3071, (ii) the bearings 3023, and/or (iii) the operating surface(s) 3024*a* may be designed to determine the distance, time, rate, force, etc. of the movement of the bearings 3023 after the cartridge has been fired. For example, the geometry of the recesses 3061, 3071 and/or the operating surfaces 3024*a* may be changed to increase/decrease cycling rate, adapt for different ammunition (e.g., caliber, bullet weight, powder charge, etc.), optimize for suppressed/unsuppressed, or any other appropriate purpose. Although the recesses 3061, 3071 are illustrated as being oriented in the radial direction, the recesses 3061 may be oriented in any other appropriate direction.

In some embodiments, the firearm operating system 3000 can be tuned by replacing the bolt 3020. Each bolt 3020 includes a geometric relationship between the operating surface(s) 3024*a* and the direction X. To tune the firearm operating system 3000, an operator may replace the bolt 3020 to change the geometric relationship between the bearings 3023 and the bolt 3020. Different bolts 3020 can be used to account for changes in caliber, bullet weight, powder charge, barrel length, etc. or may be designed to optimize for suppressed/unsuppressed, to increase/decrease cycling rate, or any other appropriate purpose. In some cases, different bolts 3020 have a different angle between the centerline of each operating surface 3024*a* and the direction X. In other cases, different bolts 3020 have a more complex geometric relationship with the direction X which may include a circular arc, a non-circular arc, a polynomial relationship, an average angle, and/or any other appropriate relationship (e.g., including, but not limited to, a curved line segment).

Accordingly, after sufficient force is applied to the operating surface(s) 3024*a*, the bolt 3020 moves rearward relative to the barrel extension 3060 due to the force applied between the recesses 3061, 3071 of the barrel extension 3060 and the bearings 3023. Once the bearings 3023 have moved a sufficient distance to allow clearance of the bolt 3020 through the barrel extension 3060, the delay is over and the bolt assembly moves rearward into the upper receiver 30. As described above, the subsequent cycling includes extracting/ejecting a cartridge or empty shell, compressing a buffer spring (not shown), pushing the upper-most cartridge out of the magazine and toward the chamber of the firearm 1, etc.

In some embodiments, the barrel extension 3060 includes a plurality of flat portions on an outer surface thereof to facilitate an interface with a tool, such as a wrench. The barrel extension 3060 may be removably attached to the barrel 50 while in other embodiments, the barrel extension 3060 is integral or permanently attached to the barrel 50. For embodiments where the barrel extension 3060 is removably attached to the barrel 50, the barrel extension 3060 may be threaded onto the barrel 50, press-fit on the barrel 50, pinned to the barrel 50, and/or attached in any other appropriate way. Removable attachment of the barrel extension 3060 allows a barrel extension 3060 to be replaced if/when wear occurs to one or more of the recesses 3061, 3071.

The operating surface(s) 3024*a* of the bolt 3020 may include concave surfaces. To promote continuous contact with the surface of the bearings 3023, each of the operating surface(s) 3024*a* may include a curved surface that approximately matches the shape of the bearing 3023. For example, if one of the bearings 3023 is spherical, the corresponding operating surface 3024*a* may be concave with a partially cylindrical shape (i.e., a partially circular cross section) to interface with the bearing 3023. In some cases, the corresponding operating surface(s) 3024*a* may be concave with a partially conical shape (i.e., a partially circular cross section) to interface with the bearing 3023. In other embodiments, the corresponding operating surface(s) 3024*a* may have other shapes including, for example, a planar shape, a curved surface with a partially elliptical shape, a partially oval shape, or any other appropriate shape. The dimensions of the corresponding operating surface(s) 3024*a* may be similar to the bearing 3023 (e.g., similar diameter) or, in some cases, may be larger than the bearing 3023 to ensure the bearing

3023 remains in contact with the operating surface(s) 3024*a*. The operating surface(s) 3024*a* may extend linearly. In other embodiments, at least a portion of a line segment through the center of operating surface(s) 3024*a* is non-linear. For example, the line segment may be parabolic, hyperbolic, a portion of a circular arc, and/or any other appropriate shape. In some embodiments, at least one of the operating surface(s) 3024*a* twists around the surface of the bolt 3020 in a corkscrew pattern.

Similarly, the recesses 3061, 3071 of the barrel extension 3060 may include concave surfaces. To promote continuous contact with the surface of the bearings 3023, each of the recesses 3061, 3071 may include a curved surface that approximately matches the shape of the bearing 3023. For example, if one of the bearings 3023 is spherical, the corresponding recess 3061, 3071 may be concave with a partially cylindrical shape (i.e., a partially circular cross section) to interface with the bearing 3023. In some cases, the corresponding recess 3061, 3071 may be concave with a partially conical shape (i.e., a partially circular cross section) to interface with the bearing 3023. In other embodiments, the corresponding recess 3061, 3071 may have other shapes including, for example, a planar shape, a curved surface with a partially elliptical shape, a partially oval shape, or any other appropriate shape. The dimensions of the corresponding recess 3061, 3071 may be similar to the bearing 3023 (e.g., similar diameter) or, in some cases, may be larger than the bearing 3023 to ensure the bearing 3023 remains in contact with the recess 3061, 3071.

The components of any of the firearms 1 and firearm operating systems 3000 described herein may be formed of materials including, but not limited to, thermoplastic, carbon composite, plastic, nylon, glass-filled nylon, polyetherimide, steel, aluminum, stainless steel, high strength aluminum alloy, tool steel, titanium, other plastic or polymer materials, other metallic materials, other composite materials, or other similar materials. Moreover, the components of the firearms may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A firearm operating system comprising:
- a bolt comprising at least one bearing cavity;
- a carrier disposed on a rear side of the bolt, wherein the carrier comprises a cavity;
- a plurality of bearings; and
- a barrel extension, wherein:
- the plurality of bearings are retained in the barrel extension during cycling of the firearm operating system including when the bolt is disengaged from the barrel extension; and
- the plurality of bearings are movable relative to the barrel extension.

2. The firearm operating system of claim 1, wherein each of the plurality of bearings comprise at least one selected from the group consisting of a sphere and a cylinder.

3. The firearm operating system of claim 1, wherein the plurality of bearings comprises at least two bearings and the movement of the at least two bearings is in a direction that is nonparallel with a forward/aft direction.

4. The firearm operating system of claim 1, wherein each of the plurality of bearings comprise:
- an internal configuration wherein each bearing is internal to the barrel extension and does not extend beyond an inner surface of the barrel extension; and
- an extended configuration wherein at least a portion of each bearing extends beyond the inner surface of the barrel extension such that each bearing protrudes into an internal cavity of the barrel extension.

5. The firearm operating system of claim 1, wherein the at least one bearing cavity comprises an operating surface that interface with at least one of the plurality of bearings when the bolt moves forward relative to the barrel extension.

6. The firearm operating system of claim 1, wherein the firearm operating system is compatible with a milspec AR-15 upper receiver.

7. The firearm operating system of claim 1, further comprising a lever arm with a pivot that is approximately centrally located.

8. The firearm operating system of claim 7, wherein the pivot rotates about an axis that is approximately vertical.

9. The firearm operating system of claim 7, wherein the lever arm constrains movement of the bolt relative to the carrier.

10. The firearm operating system of claim 1, wherein the at least one bearing cavity extends in a direction that is oblique to a longitudinal axis of the bolt.

11. A firearm operating system comprising:
- a bolt comprising a plurality of cavities;
- a plurality of bearings; and
- a barrel extension, wherein:
- the plurality of bearings are retained in the barrel extension during cycling of the firearm operating system including when the bolt is disengaged from the barrel extension; and
- the plurality of bearings are movable relative to the barrel extension.

12. The firearm operating system of claim 11, wherein each of the plurality of bearings comprise at least one selected from the group consisting of a sphere and a cylinder.

13. The firearm operating system of claim 11, wherein the plurality of bearings comprises at least two bearings and the movement of the at least two bearings is in a direction that is nonparallel with a forward/aft direction.

14. The firearm operating system of claim 11, wherein each of the plurality of bearings comprise:
- an internal configuration wherein each bearing is internal to the barrel extension and does not extend beyond an inner surface of the barrel extension; and
- an extended configuration wherein at least a portion of each bearing extends beyond the inner surface of the barrel extension such that each bearing protrudes into an internal cavity of the barrel extension.

15. The firearm operating system of claim 11, wherein each of the plurality of cavities comprises an operating surface that interface with at least one of the plurality of bearings when the bolt moves forward relative to the barrel extension.

16. The firearm operating system of claim 11, wherein the firearm operating system is compatible with a milspec AR-15 upper receiver.

17. The firearm operating system of claim 11, further comprising a lever arm with a pivot that is approximately centrally located.

18. The firearm operating system of claim 17, wherein the pivot rotates about an axis that is approximately vertical.

19. The firearm operating system of claim 17, wherein the lever arm constrains movement of the bolt relative to a carrier.

20. The firearm operating system of claim 11, wherein each of the plurality of cavities extends in a direction that is oblique to a longitudinal axis of the bolt.

21. A firearm operating system comprising:

a bolt comprising a plurality of cavities;

a plurality of bearings;

a lever arm with a pivot that is approximately centrally located; and a barrel extension, wherein:

the plurality of bearings are movable relative to the barrel extension; and the lever arm constrains movement of the bolt relative to a carrier.

* * * * *